United States Patent [19]

Plummer et al.

[11] Patent Number: 4,505,810

[45] Date of Patent: Mar. 19, 1985

[54] HYDROGEN TETRACHLOROALUMINATE AS A CO-CATALYST WITH SODIUM TETRACHLOROALUMINATE FOR THE CONVERSION OF HEAVY HYDROCARBONS

[75] Inventors: Mark A. Plummer, Littleton; Robert C. Bugle, Fort Collins, both of Colo.

[73] Assignee: Marathon Oil Company, Findlay, Ohio

[21] Appl. No.: 567,195

[22] Filed: Dec. 30, 1983

[51] Int. Cl.[3] ..... C10G 11/08; C10G 19/067; C10G 29/12; C10G 47/08

[52] U.S. Cl. ..... 208/108; 208/117; 208/214; 208/248; 208/263; 208/254 H; 208/230

[58] Field of Search ..... 208/115, 116, 117, 214, 208/248, 263, 297, 108, 230

[56] References Cited

U.S. PATENT DOCUMENTS

| | | | |
|---|---|---|---|
| 1,825,294 | 9/1931 | Wolcott | 208/117 |
| 2,113,028 | 4/1938 | Kuentzel | 585/532 |
| 2,125,235 | 7/1938 | Atwell | 585/517 |
| 2,146,667 | 2/1939 | Atwell | 585/532 |
| 2,342,073 | 2/1944 | Cheney | 585/742 |
| 2,360,700 | 10/1944 | McAllister et al. | 208/117 |
| 2,369,444 | 2/1945 | D'Ouville et al. | 208/117 |
| 2,388,007 | 10/1945 | Pardee et al. | 585/460 |
| 2,394,898 | 2/1946 | Cheney et al. | 585/742 |
| 2,768,935 | 10/1956 | Watkins | 208/113 |
| 3,324,192 | 6/1967 | Roebuck et al. | 585/460 |
| 3,764,515 | 10/1973 | Kiovsky | 208/10 |
| 3,966,582 | 6/1976 | Cramer | 208/8 |
| 4,317,712 | 3/1982 | Farcasiu | 208/46 |
| 4,333,815 | 6/1982 | Vermeulen et al. | 208/10 |

OTHER PUBLICATIONS

R. C. Bugle et al, Nature, vol. 274, No. 5671, pp. 578–580.

A. P. Lien et al, "Rate of Isomerization of Cyclohexane," Industrial and Engineering Chemistry, vol. 44, pp. 351–353, (Feb. 1952).

H. R. Alul et al, "Alkylation of Benzene with 8-Methyl-1-none. V. Effect of the Catalyst on the Isomerization of Secondary Carbonium Ions," J. Org. Chem., vol. 37, No. 25, 1972.

G. Boehme et al, "Optimal Insertion of Liquid Catalysts Based on Aluminum Chloride into Cationic Hydrocarbon Reactions," Chemical Abstracts, vol. 89, 1978, No. 89:46083V.

R. L. Richardson et al, "A Study of the Hydrogen Chloride—Aluminum Chloride System," J. Am. Chem. Soc., 73–5096–9, (1951).

H. C. Brown et al, "The Catalytic Halides. I. A Study of the Catalyst Couple, Aluminum Chloride—Hydrogen Chloride, and the Question of the Existence of $HAlCl_4$," J. Am. Chem. Soc., 73–4681–3, (1951).

*Primary Examiner*—Delbert E. Gantz
*Assistant Examiner*—O. Chaudhuri
*Attorney, Agent, or Firm*—Jack L. Hummel; Rodney F. Brown

[57] ABSTRACT

A process for producing lower average molecular weight products from heavy liquid hydrocarbons is provided comprising contacting the feed material in the presence of a co-catalyst system comprising a molten salt of sodium tetrachloroaluminate ($NaAlCl_4$) and hydrogen tetrachloroaluminate ($HAlCl_4$) at a pressure of from about 0.8 to about 140 atm (81 to about 14185 kPa) and a temperature of from about 200° C. to about 550° C.

According to the present invention use of the $HAlCl_4$ as a co-catalyst with $NaAlCl_4$ results in increased yields of lower average molecular weight products and improved levels of denitrogenation and desulfurization. The elements of the co-catalyst system may be prepared separately and mixed.

23 Claims, No Drawings

HYDROGEN TETRACHLOROALUMINATE AS A CO-CATALYST WITH SODIUM TETRACHLOROALUMINATE FOR THE CONVERSION OF HEAVY HYDROCARBONS

FIELD OF THE INVENTION

This invention relates to processes for upgrading heavy liquid hydrocarbons to lower average molecular weight products and, in particular, to the use of sodium tetrachloroaluminate and hydrogen tetrachloroaluminate as co-catalysts.

BRIEF DESCRIPTION OF THE PRIOR ART

Extensive work has been directed towards transforming heavy hydrocarbons such as liquified coal, asphalts, petroleum residual oils and the like into lower average molecular weight, more useful, hydrocarbon products, such as synthetic crudes. Most processes relate to the cracking and subsequent hydrogenation of such feed materials in the presence of a variety of catalysts including molten salts. Most known processes involve consumption of expensive hydrogen and/or the rejection of carbon to a low value product. Exemplary of such processes are those described in U.S. Pat. Nos. 3,966,582; 2,768,935; 4,317,712; 4,333,815; 1,825,294 and 3,764,515. These teach the use of a wide variety of halide salts and mixtures thereof as the catalytic reaction matrix. U.S. Pat. No. 4,317,712 and U.S. Pat. No. 4,333,815 disclose mixing aromatic hydrocarbons with a coal or petroleum oil feed which is subsequently cracked using $ZnCl_2$ and $AlCl_3$ as Friedal-Crafts catalysts. U.S. Pat. Nos. 1,825,294 and 3,764,515 disclose the use of a gaseous mineral acid, such as HCl, as a promoter for $ZnCl_2$ and $AlCl_3$. These references do not, however, teach the use of sodium tetrachloroaluminate ($NaAlCl_4$) or hydrogen tetrachloroaluminate ($HAlCl_4$), alone or together, as useful catalysts for reducing the average molecular weight of liquid hydrocarbons. $NaAlCl_4$ is disclosed as a heat transfer agent in the treatment of oil shale with subsequent benzene extraction to produce raw shale oil, i.e., R. C. Bugle, et al, Nature, Vol. 274, No. 5671, pp. 578–580. In Bugle, et al, $NaAlCl_4$ appears to act primarily to dissolve the mineral matter associated with the shale so that more kerogen surface is exposed to efficient thermal cracking and subsequent extraction with benzene. There is no teaching as to the effectiveness of $NaAlCl_4$ in reduction of the kerogen to lower molecular weight products and, in fact, no volatile liquid product is disclosed as having been achieved via only oil shale contact with $NaAlCl_4$. The reference thus teaches the need for subsequent solvent extraction.

$NaAlCl_4$ is a known catalyst for a number of reactions. For example, U.S. Pat. No. 2,125,235 and 2,146,667 disclose the use of $NaAlCl_4$ for polymerization of hydrocarbon gases, e.g., olefins. U.S. Pat. No. 2,342,073 discloses the use of $NaAlCl_4$ for the isomerization or paraffins. U.S. Pat. Nos. 2,388,077 and 3,324,192 teach the use of $NaAlCl_4$ as a catalyst to alkylate aromatic hydrocarbons. U.S. Pat. No. 2,113,028 teaches a method of regenerating such double halide catalysts as $NaAlCl_4$. None of these references, however, suggests the use of $NaAlCl_4$ as a catalyst, either alone or in conjunction with $HAlCl_4$, for molecular weight reduction of heavy liquid hydrocarbons.

$HAlCl_4$ is likewise a known catalyst for at least a small number of reactions, i.e. isomerization and condensation reactions. For example, Lien et al, in an article entitled "Rate of Isomerization of Cyclohexane," Industrial and Engineering Chemistry, Vol. 44, pp. 351–353 (February 1952), disclose the effects of $AlCl_3$ and HCl as catalysts under varying conditions on the rate of isomerization. Alul et al, "Alkylation of Benzene with 8-Methyl-1-nonene. V. Effect of the Catalyst on the Isomerization of Secondary Carbonium Ions," *J. Org. Chem.*, Vol. 37, No. 25, 1972, teach the $AlCl_3$ in conjunction with HCl is a very strong catalyst which isomerizes secondary alkylbenzenes and dealkylates the tertiary isomer. Other catalytic uses of $AlCl_3$ and HCl are disclosed in "Optimal Insertion of Liquid Catalysts Based on Aluminum Chloride into Cationic Hydrocarbon Reactions," Boehme et al, Chemical Abstracts, Vol. 89, 1978, No. 89:46083V; "A study of the Hydrogen Chloride-Aluminum Chloride System," by Ryden L. Richardson and Sidney W. Benson, *J. Am. Chem. Soc.*, 73-5096-9 (1951); and "The Catalytic Halides. I. A Study of the Catalyst Couple, Aluminum Chloride-Hydrogen Chloride, and the Question of the Existence of $HAlCl_4$," by Herbert C. Brown and Howard Pearsall, *J. Am. Chem. Soc.*, 73-4681-3 (1951).

Heretofore, there has been no recognition that $NaAlCl_4$ and $HAlCl_4$ may advantageously be utilized together as an effective co-catalyst system for increasing the yield of lower boiling point products and/or producing lower average molecular weight products during treatment of heavy liquid hydrocarbons.

Accordingly, it is an object of this invention to provide processes wherein such a co-catalyst system is used.

BRIEF SUMMARY OF THE INVENTION

A process for producing lower average molecular weight products from heavy liquid hydrocarbon feeds is provided comprising contacting the feed material in the presence of a co-catalyst system comprising a molten salt of sodium tetrachloroaluminate ($NaAlCl_4$) and hydrogen tetrachloroaluminate ($HAlCl_4$) at a pressure of from about 0.8 to about 140 atm (81 to about 14185 kPa) and a temperature of from about 200° C. to about 550°0 C.

According to the present invention use of $HAlCl_4$ as a co-catalyst with $NaAlCl_4$ results in increased yields of lower average molecular weight hydrocarbons and improved levels of denitrogenation and desulfurization. The elements of the co-catalyst system may be prepared separately and mixed. Alternatively, the co-catalyst system may be prepared by adding hydrogen chloride (HCl) and aluminum chloride ($AlCl_3$) to $NaAlCl_4$ or by mixing sodium chloride (NaCl), $AlCl_3$ and HCl.

DETAILED DESCRIPTION OF THE INVENTION

According to the present invention, a process is provided wherein a molten salt system of $NaAlCl_4$ and $HAlCl_4$ is utilized to disporportionate heavy hydrocarbon feeds into lower average molecular weight hydrocarbon products. The $HAlCl_4$ contributes hydrogen during the process and the resulting products can have higher hydrogen to carbon (H:C) ratios than the feed. The process generally comprises contacting the feed material with the molten salt system at moderate to low temperatures and pressures as described hereinbelow.

The feed materials useful in the practice of the present invention are heavy, or high molecular weight hydrocarbons, typically viscous liquids, such as liquified or solvent refined coal, asphalt, including asphaltenes and preasphaltenes, tar, shale oil, petroleum residual oils, oils extracted from tar sands, and heavy petroleum crude oils, typically boiling below about 850° C. In general, while most advantageously applied to petroleum residuals and shale oils, virtually any hydrocarbon feed which can be liquefied at process conditions can be utilized.

The $NaAlCl_4$ molten salt portion of the catalyst system useful in the practice of the present invention comprises a mixture of aluminum chloride ($AlCl_3$) and sodium chloride (NaCl) on about a one to one molar basis and is manufactured at about 155° C. to about 225° C. with reaction times of about 5 to about 30 minutes. In some instances the $NaAlCl_4$ is made by using a ratio of $AlCl_3$ to NaCl slightly greater than one to one, i.e., that there be about 1 to 10 mole percent excess of $AlCl_3$, in order to assure complete conversion of NaCl to $NaAlCl_4$. In these instances, after formation of $NaAlCl_4$ substantially all of the excess $AlCl_3$ is vaporized leaving the basic 1:1 molar ratio.

Where $NaAlCl_4$ is prepared separately the co-catalyst system may advantageously be prepared by the addition of $AlCl_3$ and HCl to the $NaAlCl_4$. Typically, $AlCl_3$ in an amount comprising from about 1.0 to about 20.0 weight percent of the $AlCl_3$-$NaAlCl_4$ mixture is added thereto under a gaseous HCl pressure of from about 0.8 to about 50.0 atm (81 to 5066 kPa), at temperatures of from about 150° C. to about 350° C., and reaction times of about 0.1 to about 2.0 hrs. Preferably, the final $HAlCl_4$ content in the $NaAlCl_4$/$HAlCl_4$ co-catalyst is from about 0.5 to about 25.0 weight percent. More preferably the $HAlCl_4$ content of the final co-catalyst is about 1.0 to about 15.0 weight percent, and most preferably is about 1.5 to about 5.0 weight percent.

The process for converting heavy liquid hydrocarbons to lower average molecular weight products is most advantageously operated at pressures from about 0.8 to about 140 atm (about 81 to about 14185 kPa), preferably from about 7 to about 70 atm (about 709 to about 7093 kPa). These pressures represent a significant decrease from those required in most commercial molecular weight reduction processes via hydrogenation. The reaction temperature at which the feed and molten $NaAlCl_4$/$HAlCl_4$ co-catalyst are contacted is above 200° C., and preferably from about 275° C. to about 550° C. and more preferably from about 400° C. to about 455° C. The contacting or residence time of the feed hydrocarbon is from about 0.25 to about 4.0 hr (lb catalyst per lb of feed per hr).

Selection of the molecular weight reduction conditions and the catalyst composition is dependent to some extent upon the feed material but mostly on the desired average molecular weight of the product slate and on the desired level of contaminant (i.e., sulfur, nitrogen, and oxygen) removal. It is preferable that the hydrocarbon products be liquids with melting points below about 200° C. The liquid product can be a synthetic crude or a refined product having a boiling range below about 540° C., e.g. gasoline, kerosene, gas oil and the like. The liquid product can contain a portion which exhibits molecular weights in the range of those exhibited by the feed hydrocarbon. However, in such instances the average molecular weight of the liquid product will be less than the average molecular weight of the feed hydrocarbon. Alternatively, the liquid product can essentially contain only components whose molecular weights are below the molecular weight range of the feed hydrocarbon. It is also preferable to minimize the conversion of feed hydrocarbon to catalyst residue and to gaseous products.

In operation, it is believed that the molten salt co-catalyst system of the present invention is not acting merely as a molecular weight reduction catalyst. The catalysts as indicated herein have been used in paraffin isomerization, alkylation of aromatics and olefin saturation and polymerization. Accordingly, it is believed that the initial function of the molten $NaAlCl_4$/$HAlCl_4$ co-catalyst of the present invention is in the formation of free radicals from a portion of the feed. The free radicals thus produced react via a series of mechanisms to form a liquid product primarily comprising branched paraffins, aromatics and naphthenes. However, when $NaAlCl_4$ is used alone without the $HAlCl_4$ component for treating, i.e. breaking up, heavy liquid hydrocarbons, a significant portion of the feed, e.g. 20 to 30%, reports to the catalyst as a residue. The use of a hydrogen overpressure, ostensibly as a source of hydrogen to minimize this effect, does little to alleviate the situation and leads to the conclusion that the hydrogen in the reaction atmosphere will not significantly split up or otherwise assist in hydrogenation of the hydrocarbons present.

Contrary to and in comparison with results obtained by practice of the present invention, it now appears that with use of only $NaAlCl_4$, a significant level of N or S present in the feed is recovered with the products, while the formed hydrocarbon radicals undergo polymerization to catalyst residue. The polymerized residue has a hydrogen to carbon (H/C) ratio of about 0.9 to 1 suggesting that such residues are not primarily due to coking, i.e. hydrogen removal from a portion of the feed to hydrogenate the liquid product. It is believed that in the practice of the present invention the presence of the $HAlCl_4$ as a catalyst itself or at the site of the $NaAlCl_4$ catalyst surface provides a source of hydrogen to the hydrocarbon radicals formed which among other things lessens the polymerization of such radicals thereby enhancing production and/or recovery of lower average molecular weight products. The presence of $HAlCl_4$ as a hydrogen source to saturate the free radicals minimizes the rejection of residue to the catalyst surface. Thus, the time interval between the periodic removals of this residue to regenerate the catalyst can be extended.

Additionally, the presence of the $HAlCl_4$ component can facilitate production of a liquid product with an increased H/C ratio. The $NaAlCl_4$/$HAlCl_4$ co-catalyst also improves the level of contaminant removal. Hence, the $HAlCl_4$ component allows for greater consumption of an external hydrogen source to accomplish these results than does the use of $NaAlCl_4$ alone.

Certain hydrocarbon feedstocks contain components exhibiting very low H/C ratios. While these components could quickly form carbon residues on the $NaAlCl_4$ catalyst which cannot be easily removed by hydrogen generated in situ from the feedstock or supplied externally, the presence of the $HAlCl_4$/$NaAlCl_4$ together minimizes this effect.

In operation, the process of the present invention uses a purge gas, which is typically recycled, to remove the liquid product from the molten $NaAlCl_4$/$HAlCl_4$. The purge gas typically present in an amount sufficient to effect product removal can be either an inert gas such as nitrogen, argon, helium, and the other Inert Gases of the Periodic Table, methane or other low molecular weight paraffins, etc. or a reactive gas such as hydrogen, carbon monoxide or low molecular weight aromatics and olefins. Mixtures of inert and reactive gases can also be used. The purge gas can also contain a quantity of hydrogen chloride gas to counteract the introduction of oxygen as a feed contaminant or in the form of dissolved water. Oxygen will convert the catalyst from the chloride to the oxide form.

These and other aspects of the invention may be best understood by reference to the following examples which are offered by way of illustration and not by way of limitation.

EXAMPLES

Example I

Preparation of $NaAlCl_4/HAlCl_4$ Co-catalyst Matrix $NaAlCl_4$ was prepared by mixing $AlCl_3$ and NaCl in an initial 1.02 to 1.00 mole ratio, respectively, for about 12–15 minutes at a temperature of about 185°–205° C. and a pressure of 0.82 atm (82.9 kPa). The batch reaction was terminated when all the excess $AlCl_3$ was vaporized from the molten catalyst.

Except for run no. 1 where no $AlCl_3$ was introduced, $HAlCl_4$ was then incorporated by adding $AlCl_3$ to 5.66–7.83 weight percent in the mixture and reacting the $AlCl_3$ with gaseous HCl. The conditions and results of six different runs were as follows:

TABLE 1

| Run No. | Wt % $AlCl_3$ | HCl Pressure atm. (kPa) | Temperature °C. | Time min | Wt % $HAlCl_4$ in Co—catalyst |
|---|---|---|---|---|---|
| 1 | None | — | — | — | None |
| 2 | 5.66 | 0.82 (82.9) | 154 | 8 | 1.43 |
| 3 | 5.66 | 0.82 (82.9) | 297 | 15 | 3.08 |
| 4 | 5.66 | 22.5 (2275) | 297 | 45 | 5.79 |
| 5 | 5.66 | 48.4 (4902) | 301 | 45 | 7.08 |
| 6 | 7.83 | 43.6 (4420) | 294 | 45 | 9.74 |

Example II

Molecular Weight Reduction of Heavy Hydrocarbons

The following examples and optimization studies were performed using a shale oil obtained by a Marathon Oil Company process and $NaAlCl_4/HAlCl_4$ molten salts. The experiments were performed at the conditions indicated in a continuous reactor for the molecular weight reduction runs.

Six molecular weight reduction runs using the catalysts of Example I were performed at conditions of: 64.6±2.6 minutes residence time, a temperature of 428±2° C. and a pressure of 55.3±0.3 atm (5599±33 kPa). A hydrogen purge of $7.81\pm0.82\times10^{-3}$ liters/min/gm catalyst was employed. Liter volumes are at 15.6° C. and 1 atm (101.3 kPa). The results are provided in Table 2. These results were obtained at throughputs of 0.47±0.03 to 1.06±0.30 wt. of feed per wt. of catalyst and then the runs were terminated.

TABLE 2

Effect of $HAlCl_4$ Content on Product Yields and Quality, Contaminant Removal, and Hydrogen Consumption

| Run No. | Wt % $HAlCl_4$ | Wt % Yields* Gas | Liquid | Residue | Wt % Contaminate Removal N | S | Hydrogen Consumption** lit/kg | scf/bbl |
|---|---|---|---|---|---|---|---|---|
| 1 | None | 4.3 | 71.0 | 22.4 | 44.9 | 35.3 | 41 | 232 |

TABLE 2-continued

Effect of $HAlCl_4$ Content on Product Yields and Quality, Contaminant Removal, and Hydrogen Consumption

| Run No. | Wt % $HAlCl_4$ | Wt % Yields* Gas | Liquid | Residue | Wt % Contaminate Removal N | S | Hydrogen Consumption** lit/kg | scf/bbl |
|---|---|---|---|---|---|---|---|---|
| 2 | 1.43 | 1.8 | 85.6 | 9.8 | 66.6 | 76.4 | 191 | 1085 |
| 3 | 3.08 | 1.8 | 87.4 | 7.4 | 76.3 | 88.0 | 131 | 742 |
| 4 | 5.79 | 1.5 | 80.0 | 15.8 | — | — | — | — |
| 5 | 7.08 | 1.4 | 78.4 | 17.7 | — | — | — | — |
| 6 | 9.74 | 1.5 | 71.4 | 25.0 | 32.8 | 11.5 | — | — |

*Balance is removed nitrogen, sulfur and oxygen.
**Volumes at 15.6° C. and 1 atm (101.3 kPa).

The above results show an optimum $HAlCl_4$ content in the $HAlCl_4/NaAlCl_4$ molten catalyst of about 2.5 weight percent for the specific feed. The increase in hydrogen consumption partially results in an increase in the H/C ratio of the liquid products. The melting points of the liquid products are below 25° C., and the liquid products exhibit average molecular weights well below the average molecular weight of the shale oil feed. The liquid products are classified as 10 percent ethane to i-butane, 75 percent gasoline (i-butane to 218° C. boiling range), and 15 percent kerosene-gas oil (218°–538° C. boiling range).

Although the foregoing invention has been described in some detail by way of illustration and example for purposes of clarity of understanding, it will be obvious that certain changes and modifications may be practiced within the scope of the invention, as limited only by the scope of the appended claims.

What is claimed is:

1. A process for producing a lower average molecular weight product from a higher molecular weight hydrocarbon feedstock comprising contacting said feedstock with a molten salt system consisting essentially of $NaAlCl_4$ and $HAlCl_4$, having substantially no excess NaCl or $AlCl_3$ and having from about 0.5 to about 25 weight percent $HAlCl_4$, at a pressure of about 0.8 to about 140 atmospheres and a temperature above about 200° C.

2. A process according to claim 1 wherein said temperature is from about 275° C. to about 550° C.

3. A process according to claim 2 wherein said temperature is about 400° C. to about 455° C.

4. A process according to claim 1 wherein said pressure is from about 7 to about 70 atmospheres.

5. A process according to claim 1 wherein the contacting is for a time period of from about 0.25 hour to about 4.0 hour.

6. A process according to claim 1 wherein the $NaAlCl_4$ and the $HAlCl_4$ are prepared separately and mixed together to form said molten salt system.

7. A process according to claim 1 wherein said salt system is prepared by adding HCl and $AlCl_3$ to $NaAlCl_4$.

8. A process according to claim 1 wherein said molten salt system is prepared by mixing NaCl, $AlCl_3$ and HCl.

9. A process according to claim 1 wherein said higher molecular weight hydrocarbon feedstock comprises at least one heavy liquid hydrocarbon selected from the group consisting of liquefied or solvent refined coal, asphalt, asphaltenes, pre-asphaltenes, tar, shale oil, petroleum residual oils, oils extracted from tar sands, heavy petroleum crude oils boiling below about 850° C., and mixtures thereof.

10. A process according to claim 1 further comprising separating said product by purging with a purge gas.

11. A process according to claim 10 wherein at least a portion of said purge gas is reactive.

12. A process according to claim 11 wherein said reactive purge gas is selected from the group consisting of hydrogen, carbon monoxide, low molecular weight aromatics, low molecular weight olefins, and mixtures thereof.

13. A process according to claim 10 wherein at least a portion of said purge gas is inert.

14. A process according to claim 13 wherein said inert purge gas is selected from the group consisting of nitrogen, helium, argon, methane or other low molecular weight paraffins, and mixtures thereof.

15. A process according to claim 10 wherein said purge gas is separated from said product and is recycled.

16. A process according to claim 1 wherein the hydrogen to carbon ratio of said product is greater than the hydrogen to carbon ratio of the feedstock.

17. A process according to claim 1 wherein substantially all the components of the product have molecular weights below the molecular weight range of said feedstock.

18. A process for producing a lower average molecular weight product from a higher molecular weight hydrocarbon feedstock comprising contacting said feedstock with a molten salt system consisting essentially of $NaAlCl_4$ and $HAlCl_4$, having substantially no excess NaCl or $AlCl_3$ and having from about 0.5 to about 25 weight percent $HAlCl_4$, at a pressure of from about 0.8 to about 140 atmospheres and a temperature above about 200° C. wherein the molten salt system is prepared according to a process comprising:

(a) adding $AlCl_3$ to a molten $NaAlCl_4$ in an amount of from about 1.0 to about 20.0 weight percent of the combined molten $AlCl_3/NaAlCl_4$ system; and (b) contacting the mixture of part (a) with gaseous HCl at a pressure of from about 0.8 to about 50.0 atmospheres at a temperature of from about 150° C. to about 350° C. for a reaction time of about 0.1 to about 2.0 hours to form said system of $NaAlCl_4$ and $HAlCl_4$.

19. The process of claim 18 wherein the $HAlCl_4$ content of the salt system is about 1.0 to about 15.0 percent by weight.

20. The process of claim 19 wherein the $HAlCl_4$ content of the said salt system is about 1.5 to about 5.0 percent by weight.

21. A process according to claim 18 wherein said contacting of the feedstock and the molten salt system occurs at a temperature of from about 275° C. to about 550° C.

22. A process according to claim 18 further comprising separating said product from said molten salt system by purging with a purge gas.

23. A process according to claim 18 wherein the hydrogen to carbon ratio of said product is greater than the hydrogen to carbon ratio of the feedstock.

* * * * *